US006425561B2

(12) United States Patent
Wooten et al.

(10) Patent No.: US 6,425,561 B2
(45) Date of Patent: Jul. 30, 2002

(54) ADJUSTABLE WEAPON AUXILIARY MOUNT

(75) Inventors: Donald W. Wooten; Robert M. Wohlfeld, both of Dallas, TX (US)

(73) Assignee: Tactical & Rescue Equipment, LLC, Plano, TX (US)

( * ) Notice: Subject to any disclaimer, the term of this patent is extended or adjusted under 35 U.S.C. 154(b) by 0 days.

(21) Appl. No.: 09/882,791

(22) Filed: Jun. 14, 2001

Related U.S. Application Data

(63) Continuation of application No. 09/434,214, filed on Nov. 4, 1999.

(60) Provisional application No. 60/107,766, filed on Nov. 9, 1998.

(51) Int. Cl.[7] ..... A47B 96/06

(52) U.S. Cl. ..... 248/229.1; 362/113

(58) Field of Search ..... 248/229.1, 229.12, 248/229.15, 230.3, 231.21, 316.4, 220.21, 70, 74.3, 74.4; 42/101, 103; 362/110, 113, 114; 33/245

(56) References Cited

U.S. PATENT DOCUMENTS

| | | | |
|---|---|---|---|
| 552,951 | A | 1/1896 | Bower |
| 2,876,027 | A | 3/1959 | Sulmonetti |
| 3,506,227 | A | 4/1970 | Jenkins |
| 3,750,318 | A | 8/1973 | Burris |
| 4,429,468 | A | 2/1984 | Jiminez et al. |
| 4,959,908 | A | 10/1990 | Weyrauch |
| 5,033,219 | A | 7/1991 | Johnson et al. |
| 5,086,566 | A | 2/1992 | Klumpp |
| 5,669,173 | A | 9/1997 | Rodney, Jr. |
| 5,787,630 | A | 8/1998 | Martel |
| 5,926,964 | A | 7/1999 | Korapaty |
| 5,941,006 | A | 8/1999 | Horton |
| 6,126,122 | A | 10/2000 | Ismert |

OTHER PUBLICATIONS

McMaster–Carr Supply Co. Catalogue (Georgia Catalogue) vol. 105; p. 2099, "Pipe & Woodworkers' Vises"—See "Bench Yoke Pipe Vises".

McMaster–Carr Supply Co. Catalogue (Georgia Catalogue) vol. 105; p. 2102, "Machinists' & Combination Vises"—See "Macarco Heavy Duty Vises"—"Macarco Combination".

*Primary Examiner*—Leslie A. Braun
*Assistant Examiner*—A. Joseph Wujciak, III
(74) *Attorney, Agent, or Firm*—Dunlap, Codding & Rogers

(57) ABSTRACT

An adjustable weapon auxiliary mount for mounting devices of different diameters, one at a time, to a rail of a weapon. The adjustable weapon auxiliary mount is provided with a base, a device clamp and a rail clamp. The base has a first end, an opposed second end, and a clamping surface formed therebetween. The device clamp is mounted to the base. The device clamp is provided with a clamping member having a clamping surface facing the clamping surface of the base and spatially disposed therefrom so as to define a receiving space for receiving one device and securely gripping the device. The clamping surfaces of the clamping member and the base are configured to securely grip, one at a time, devices having varying diameters within a predetermined range. The device clamp is also provided with a clamping assembly for connecting the clamping member of the device clamp to the base so as to permit adjustment of the receiving space within a predetermined range and thereby permit the devices having varying diameters within the predetermined range to be securely mounted within the receiving space. The rail clamp connects the base to the rail of the weapon.

10 Claims, 1 Drawing Sheet

ADJUSTABLE WEAPON AUXILIARY MOUNT

CROSS-REFERENCE TO RELATED APPLICATIONS

This is a continuation of U.S. Ser. No. 09/434,214, filed Nov. 4, 1999, the entire content of which is hereby expressly incorporated herein by reference, which claims priority to the provisional patent application identified by application Ser. No. 60/107,766, which was filed on Nov. 9, 1998, the entire content of which is hereby expressly incorporated herein by reference.

STATEMENT REGARDING FEDERALLY SPONSORED RESEARCH AND DEVELOPMENT

Not Applicable.

BACKGROUND OF THE INVENTION

Devices for mounting sighting equipment, such as scopes or laser sighting equipment are known in the art. These devices are designed to mount a certain configuration and/or size of sighting equipment. For example, prior art devices for mounting scopes having a cylindrically shaped outer peripheral surface are provided with a clamping device having an interior surface which is shaped so as to mate with the cylindrically shaped outer peripheral surface of the scope. This necessitates the prior art device being designed to only securely mount a scope having a predetermined size, such as a one inch diameter. The prior art devices can not securely mount sighting equipment having different sizes, one at a time, onto a weapon.

Weapons having a rail for receiving a scope mount thereon are known in the art. The rail has been provided with a plurality of spaced apart, parallel recesses formed therein so that a recoil pin provided on the scope mount can be disposed in one of the recesses to help prevent movement of the scope mount when the weapon is being fired.

However, to applicants knowledge, an adjustable weapon auxiliary mount which is capable of securely mounting differently sized devices to the weapon, one at a time, is not available. It is to such an improved adjustable weapon auxiliary mount that the present invention is directed.

SUMMARY OF THE INVENTION

The present invention relates to an adjustable weapon auxiliary mount for mounting devices of different diameters, one at a time, to a rail of a weapon. The adjustable weapon auxiliary mount is provided with a base, a device clamp and a rail clamp.

The base has a first end, an opposed second end, and a clamping surface formed therebetween.

The device clamp is mounted to the base. The device clamp is provided with a clamping member having a clamping surface facing the clamping surface of the base and spatially disposed therefrom so as to define a receiving space for receiving one device and securely gripping the device. The clamping surfaces of the clamping member and the base are configured to securely grip, one at a time, devices having varying diameters within a predetermined range. The device clamp is also provided with a clamping assembly for connecting the clamping member of the device clamp to the base so as to permit adjustment of the receiving space within a predetermined range and thereby permit the devices having varying diameters within the predetermined range to be securely mounted within the receiving space.

The rail clamp connects the base to the rail of the weapon.

In one aspect, the present invention relates to an adjustable weapon auxiliary mount that mounts onto the rails of certain military and commercial weapons and into which the user may insert a device, such as a flashlight, for example. The adjustable weapon auxiliary mount is designed so that the beam of the flashlight, for example, will align with the barrel of the weapon so that the user can see where he/she is aiming the weapon. Or, the user may mount a device such as a scope for precise fire at longer ranges, such as a sniper might employ. The adjustable weapon auxiliary mount is designed so that when it is installed it does not interfere with the sighting or operating of the weapon. Nor does it interfere with other attached accessories.

In another aspect, the adjustable weapon auxiliary mount can be attached and removed from the weapon without the need for tools. All parts of the adjustable weapon auxiliary mount are captive on the adjustable weapon auxiliary mount. The adjustable weapon auxiliary mount is made so that it can accept any flashlight with a circular barrel whose diameter is within the range of the specific design.

DETAILED DESCRIPTION OF THE INVENTION

Figure 1:
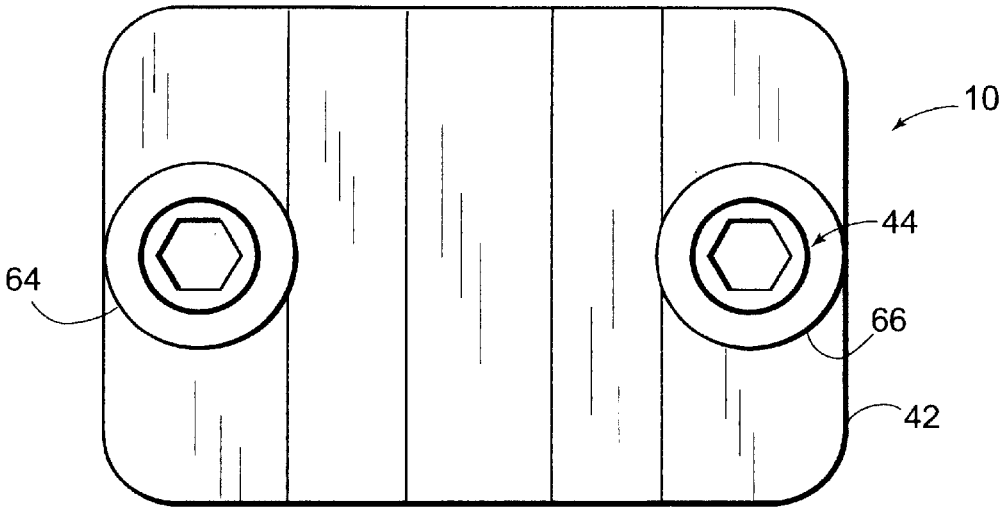
FIG. 1 is a top plan view of a adjustable weapon auxiliary mount constructed in accordance with the present invention.
Figure 2:
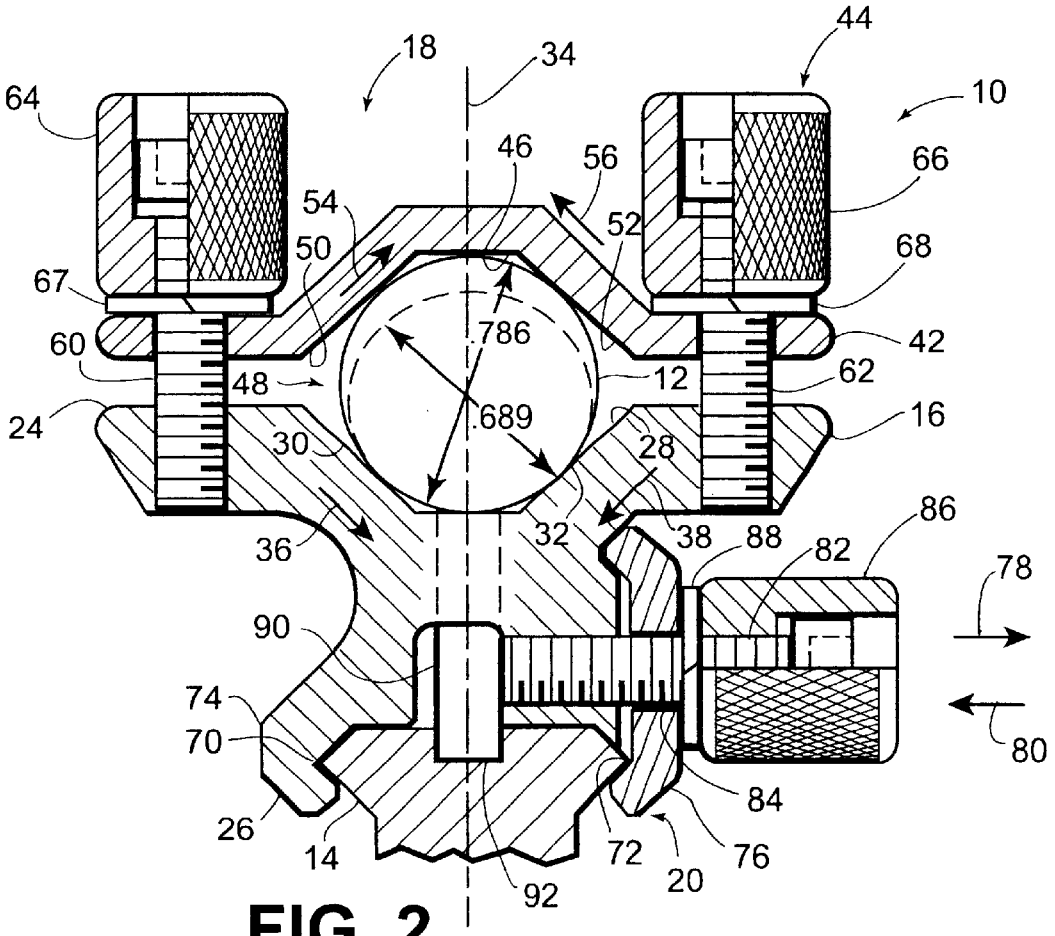
FIG. 2 is a front elevational, partial fragmental view of the adjustable weapon auxiliary mount depicted in FIG. 1 wherein a flashlight is mounted by the adjustable weapon auxiliary mount onto a rail of a weapon and certain parts of the adjustable weapon auxiliary mount are broken away to show three knurled finger nuts.

Referring now to the drawings, and in particular to FIGS. 1 and 2, shown therein and designated by the general reference 10 is an adjustable weapon auxiliary mount for mounting a variety of devices 12 of different diameters, one at a time, to a rail 14 of a weapon (not shown). The device 12 can be a flashlight, laser, scope, or other auxiliary device. In general, the adjustable weapon auxiliary mount 10 includes a base 16, a device clamp 18, and a rail clamp 20.

The base 16 has a first end 24, an opposed second end 26, and a clamping surface 28 formed there between. The clamping surface 28 of the base 16 is engageable with the device 12 and includes a first planar portion 30, and a second planar portion 32 with the first planar portion 30 of the base 16 and the second planar portion 32 of the base 16 are disposed at an angle relative to a clamp axis 34. The first planar portion 30 of the base 16 extends in a direction 36 towards the second planar portion 32 of the base 16. The second planar portion 32 of the base 16 extends in a direction 38 toward the first planar portion 30 of the base 16. The first and second planar portions 30 and 32 are engageable with the device 12.

The device clamp 18 of the adjustable weapon auxiliary mount 10 is mounted to the base 16. The device clamp 18 is provided with a clamping member 42 and a clamping assembly 44. The clamping member 42 has a clamping surface 46 facing the clamping surface 28 of the base 16. The clamping surface 46 of the clamping member 42 is spatially disposed from the clamping surface 28 of the base 16 so as to define a receiving space 48 for receiving the device 12 and securely gripping the device 12. The clamping surfaces 28 and 46 of the base 16 and the clamping member 42 are configured to engage and grip, one at a time, devices 12 having varying diameters within a predetermined range. For example, in one embodiment, the receiving space 48 can accept devices 12, such as flashlights having a circular barrel, with outer diameters from 0.689" to slightly greater than 0.768". The clamping surfaces 28 and 46 can be symmetrically constructed so as to automatically center the device 12 in the receiving space 48. As shown in FIG. 2, the clamping surfaces 28 and 46 can each have a generally trapezoidal shape. In addition, the clamping surfaces 28 and 46 can each have a generally triangular shape.

The clamping surface 46 of the clamping member 42 includes a first planar portion 50, and a second planar portion 52 with the first planar portion 50 of the clamping member 42 and the second planar portion 52 of the clamping member 42 being disposed at an angle relative to the clamp axis 34. The first planar portion 50 of the clamping member 42 extends in a direction 54 toward the second planar portion 52 of the clamping member 42. The second planar portion 52 of the clamping member 42 extends in a direction 56 toward the first planar portion 50 of the clamping member 42. The first planar portion 50 and the second planar portion 52 are engageable with the device 12.

The clamping assembly 44 of the device clamp 18 connects the clamping member 42 of the device clamp 18 to the base 16 so as to permit adjustment of the receiving space 48 within a predetermined range and thereby permit the devices 12 having varying diameters within the predetermined range to be securely mounted within the receiving space 48. The clamping assembly 44 is provided with a first captive screw 60 and a second captive screw 62. The first and second captive screws 60 and 62 are positioned on opposite sides of the receiving space 48. The first and second captive screws 60 and 62 extend through the clamping member 42 and into the base 16 with a portion of the first and second captive screws 60 and 62 extending outwardly from the clamping member 42. The first and second captive screws 60 and 62 can be secured in the base 16 either chemically with a product such as Locktite, or machine threaded so that the first and second captive screws 60 and 62 will be forced into the base 16 and not easily loosened.

The clamping assembly 44 is preferably operated or adjusted without any tools. The clamping assembly 44 is further provided with a first knurled finger nut 64, and a second knurled finger nut 66. The first knurled finger nut 64 is mounted to the portion of the first captive screw 60 extending outwardly from the clamping member 42. The second knurled finger nut 66 is mounted to the portion of the second captive screw 62 extending outwardly from the clamping member 42. The clamping assembly 44 can also be provided with a pair of lock washers 67 and 68 positioned between the first and second knurled finger nuts 64 and 66 and the clamping member 42. The lock washers 67 and 68 can be constructed of a metallic or non-metallic compressible material, such as silicone.

The rail clamp 20 of the adjustable weapon auxiliary mount 10 connects the base 16 to the rail 14 of the weapon. The rail 14 has a first side 70, and a second side 72. The rail clamp 20 includes a fixed clamp arm 74 and a movable clamp arm 76. The fixed clamp arm 74 is engageable with the first side 70 of the rail 14, and the movable clamp arm 76 is engageable with the second side 72 of the rail 14 so as to clamp the rail 14 between the fixed clamp arm 74 and the movable clamp arm 76.

As shown in FIG. 2, the fixed clamp arm 74 can be formed integrally on the second end 26 of the base 16. The movable clamp arm 76 is movable in a first direction 78 generally away from the fixed clamp arm 74, and in a second direction 80 generally toward the fixed clamp arm 74. The rail clamp 20 is also provided with a captive screw 82, which is secured to the base 16, generally near the second end 26 thereof. The captive screw 82 can be secured to the base 16 either chemically with a product such as Locktite, or machine threaded so that the captive screw 82 will be forced into the base 16 and not easily loosened. The captive screw 82 extends through an opening 84 formed through the movable clamp arm 76 such that a portion of the captive screw 82 extends outwardly from the movable clamp arm 76. The rail clamp 20 is further provided with a knurled nut 86 which is disposed on the portion of the captive screw 82 which extends outwardly from the movable clamp arm 76. The knurled nut 86 can be rotated so as to move the movable clamp arm 76 in the first and second directions 78 and 80. A lock washer 88 can be positioned in between the knurled nut 86 and the movable clamp arm 76 so as to prevent inadvertent movement of the knurled nut 86 once the rail clamp 20 is secured on the rail 14. A recoil pin 90 is attached to the base 16 and extends down so that it can engage a recess 92 in the weapon rail. The recoil pin 90 can have a diameter of 3/16". The rail 14 can be a commercially available picketed rail.

The first captive screw 60, the second captive screw 62, the captive screw 82, the first knurled finger nut 64, the second knurled finger nut 66, the knurled nut 86 can be constructed of either aluminum or stainless steel. The lock washer 88 can be constructed of a metallic or a non-metallic compressible material, such as silicone. The base 16, clamping member 42 and the movable clamp arm 76 can be made of metal or plastic. The stability of the adjustable weapon auxiliary mount 10 must be such that it can withstand the forces of the recoil when the weapon is fired and continue to hold the device 12 securely. In military applications, when automatic rifles or machine guns are employed, the adjustable weapon auxiliary mount 10 stability must endure when up to 500–1000 rounds are fired in bursts of up to 20 rounds.

To install the device 12 on the rail 14, the user first loosens the first knurled finger nut 64, the second knurled finger nut 66 and the knurled finger nut 86 by turning them counter clockwise. Then, the user fits the recoil pin 90 into the recess 92 on the rail 14 and tightens knurled finger nut 86. This secures the rail clamp 20 to the rail 14. Next, the user inserts the device 12, such as a flashlight, into the receiving space 48 and secures the device 12 between the clamping member 42 and the base 16 by tightening the first and second knurled finger nuts 64 and 66. Devices 12, such as flashlights, scopes or other devices, can be inserted and removed from the adjustable weapon auxiliary mount 10 without removing the adjustable weapon auxiliary mount 10 from the rail 14 of the weapon and without using any tools.

Changes may be made in the combinations, operations, and arrangements of the various parts and elements described herein without departing from the spirit and the scope of the invention as defined in the following claims.

What is claimed is:

1. An adjustable weapon auxiliary mount for interchangeably mounting devices of different diameters, one at a time, to a rail of a weapon, the adjustable weapon auxiliary mount comprising:

a base having a clamping surface and a recoil pin, the base being configured such that the recoil pin extends downwardly from the base and to engage the rail of the weapon;

a device clamp mounted to the base, the device clamp comprising:

a clamping member having a clamping surface facing the clamping surface of the base and spatially disposed therefrom so as to define a receiving space for receiving and securely gripping a device, the clamping surface of the clamping member having a first planar portion and second planar portion with the first planar portion and the second planar portion being disposed at an acute angle relative to a clamp axis, the clamping member and the base being configured to securely grip the device, the clamping member being adjustably connected to the base so as to permit adjustment of the receiving space within a predetermined range.

2. The adjustable weapon auxiliary mount of claim 1, wherein the clamping member further comprises a first captive screw and a second captive screw with the first and second captive screws being positioned on opposite sides of the receiving space, the first and second captive screws extending through the clamping member and threadingly engaging the base with a portion of the first and second captive screws extending from the clamping member, and wherein the first and second captive screws further comprises a first knurled finger nut and a second knurled finger nut, the first knurled finger nut being mounted to the portion of the first captive screw extending outwardly from the clamping member, and the second knurled finger nut being mounted to the portion of the second captive screw extending outwardly from the clamping member.

3. The adjustable weapon auxiliary mount of claim 1, wherein the clamping surface of the base includes a first planar portion and a second planar portion with the first planar portion of the base and the second planar portion of the base being disposed at an acute angle relative to a clamp axis.

4. An adjustable weapon auxiliary mount for interchangeably mounting devices of different sizes, one at a time, to a rail of a weapon, the adjustable weapon auxiliary mount, comprising:

a base having a first end, a second end, a recoil pin, and a clamping surface formed on the first end thereof, the base being configured such that the recoil pin extends downwardly from the base and engages the rail of the weapon;

a device clamp mounted to the base, the device clamp comprising:

a clamping member having a clamping surface facing the clamping surface of the base so as to define a receiving space for receiving a device, the clamping surface of the base having a first planar portion and a second planar portion with the first planar portion and the second planar portion being disposed at an acute angle relative to a clamp axis, and the base being configured to receive and securely grip the device; and means for adjusting the clamping member relative to the clamping surface of the base so as to secure the device between the clamping surface of the clamping member and the clamping surface of the base; and a rail clamp, wherein the rail clamp connects the adjustable weapon auxiliary mount to the rail of the weapon.

5. The adjustable weapon auxiliary mount of claim 4, wherein the clamping means comprises a first captive screw and a second captive screw with the first and second captive screws being positioned on opposite sides of the receiving space, the first and second captive screws extending through the clamping member and engaging the base with a portion of the first and second captive screws extending from the clamping member, and wherein the clamping means further comprises a first knurled finger nut and a second knurled finger nut, the first knurled finger nut being mounted to the portion of the first captive screw extending outwardly from the clamping member, and the second knurled finger nut being mounted to the portion of the second captive screw extending outwardly from the clamping member.

6. The adjustable weapon auxiliary mount of claim 5, wherein the clamping means further comprises a first washer and a second washer, the first washer positioned between the first knurled nut and the clamping member, and the second washer positioned between the second knurled nut and the clamping member.

7. The adjustable weapon auxiliary mount of claim 6, wherein the geometric configuration of the clamping member automatically centers the device being securely gripped so that the device is held parallel to the barrel of the weapon.

8. The adjustable weapon auxiliary mount of claim 6, wherein the clamping surface of the clamping member has a first planar surface and second planar surface with the first planar portion of the clamping member and the second planar portion of the clamping member being disposed at an angle relative to a clamp axis, the first planar portion of the clamping member extending toward the second planar portion of the clamping member, and the second planar portion of the clamping member extending toward the first planar portion of the clamping member.

9. The adjustable weapon auxiliary mount of claim 6, wherein the clamping surface of the base has a first planar portion and a second planar portion with the first planar portion of the base and the second planar portion of the base being disposed at an angle relative to a clamp axis, the first planar portion of the base extending toward the second planar portion of the base, and the second planar portion of the base extending toward the first planar portion of the base.

10. The adjustable weapon auxiliary mount of claim 6, wherein the clamping surface of the clamping member includes a first planar portion and a second planar portion with the first planar portion of the clamping member and the second planar portion of the clamping member being disposed at an angle relative to a clamp axis, the first planar portion of the clamping member extending toward the second planar portion of the clamping member, and the second planar portion of the clamping member extending toward the first planar portion of the clamping member, and wherein the clamping surface of the base includes a first planar portion of the base being disposed at an angle relative to the clamp axis, the first planar portion of the base extending toward the second planar portion of the base, and the second planar portion of the base extending toward the first planar portion of the base.

* * * * *